US010823122B2

(12) United States Patent
Mori et al.

(10) Patent No.: US 10,823,122 B2
(45) Date of Patent: Nov. 3, 2020

(54) SILENCING DEVICE

(71) Applicant: SUBARU CORPORATION, Tokyo (JP)

(72) Inventors: Takashi Mori, Tokyo (JP); Kyohei Yamamoto, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 392 days.

(21) Appl. No.: 15/864,670

(22) Filed: Jan. 8, 2018

(65) Prior Publication Data

US 2018/0258891 A1 Sep. 13, 2018

(30) Foreign Application Priority Data

Mar. 8, 2017 (JP) ..... 2017-044393

(51) Int. Cl.

| | |
|---|---|
| ***F02M 35/12*** | (2006.01) |
| ***G10K 11/16*** | (2006.01) |
| ***F02B 29/04*** | (2006.01) |
| ***F02M 35/10*** | (2006.01) |

(52) U.S. Cl.

CPC .... *F02M 35/1288* (2013.01); *F02M 35/1244* (2013.01); *F02M 35/1255* (2013.01); *G10K 11/161* (2013.01); *F02B 29/04* (2013.01); *F02M 35/10157* (2013.01); *F02M 35/10268* (2013.01)

(58) Field of Classification Search

CPC ..... F02M 35/1244; F02M 35/1255; F02M 35/1261; F02M 35/1266; F02M 35/1288; F02M 35/10157; F02M 35/10268; G10K 11/161; F02B 29/04

USPC ..... 181/229

See application file for complete search history.

(56) References Cited

U.S. PATENT DOCUMENTS

| | | | | |
|---|---|---|---|---|
| 5,797,265 | A | 8/1998 | Hägglund | |
| 6,102,012 | A | 8/2000 | Iiboshi et al. | |
| 2004/0069563 | A1* | 4/2004 | Zirkelbach | F01N 1/026 181/269 |

FOREIGN PATENT DOCUMENTS

| | | | |
|---|---|---|---|
| JP | S 60-093123 | A | 5/1985 |
| JP | H 06-40319 | U | 5/1994 |
| JP | H 09-4510 | A | 1/1997 |
| JP | H 11-311155 | A | 11/1999 |
| JP | 2012-127330 | A | 7/2012 |

OTHER PUBLICATIONS

Japanese Office Action, dated Aug. 14, 2018, in Japanese Application No. 2017-044393 and English Translation thereof.

* cited by examiner

*Primary Examiner* — Jeremy A Luks

(74) *Attorney, Agent, or Firm* — McGinn I. P. Law Group, PLLC.

(57) ABSTRACT

A silencing device includes an intake air pipe, a silencer, and a heater. The intake air pipe communicates with a supercharging device configured to supercharge intake air to be sucked into an engine. The intake air pipe is configured to introduce the intake air into the supercharging device. The silencer is disposed in the intake air pipe, and configured to silence air flow noise. The heater is disposed in the intake air pipe, and configured to heat the intake air introduced through the intake air pipe.

20 Claims, 4 Drawing Sheets

SILENCING DEVICE

CROSS-REFERENCE TO RELATED APPLICATIONS

The present application claims priority from Japanese Patent Application No. 2017-044393 filed on Mar. 8, 2017, the entire contents of which are hereby incorporated by reference.

BACKGROUND

1. Technical Field

The present invention relates to a silencing device, particularly to a silencing device that silences air flow noise caused by a supercharging device used in an engine.

2. Related Art

In the past, supercharging devices, such as a turbocharger, that supercharge air for intake (intake air) have been used to increase the output of engines. Also, in recent years, supercharging devices, such as a turbocharger (so-called downsizing turbo) are attracting attention as a technology that downsizes (reduces the displacement of) engines to improve the fuel consumption rate (fuel efficiency) while ensuring the power performance (output) of the engines.

In an engine equipped with a turbocharger, intake air flows backward from compressor blades during supercharge, and air flow noise (turbo air flow noise) is emitted through an intake air pipe and a intake port, and may be recognized as abnormal noise in a vehicle cabin. In order to reduce such turbo air flow noise, in a known engine (supercharging device), for instance, the intake air pipe is provided with a silencer, such as a side branch and a resonator (for instance, see Japanese Unexamined Patent Application Publication (JP-A) No. 2012-127330).

JP-A No. 2012-127330 discloses an air intake device for an engine, in which multiple resonance tubes (silencers) are mounted in an air intake duct without reducing the operability of an oil filler cap. More specifically, in the air intake device for an engine, an oil filler cap and an air cleaner are disposed close to each other in a vehicle width direction in an upper portion of the engine having a turbocharger, an air intake duct for introducing outside air to the air cleaner is extended from the air cleaner to a position which overlaps with the oil filler cap in a vehicle front-and-rear direction, the air intake duct is curved and extended in a vehicle front direction in the space between the air cleaner and the oil filler cap, and multiple resonance tubes having different resonant frequencies are mounted in the portion of the air intake duct, bounded by the oil filler cap and the air cleaner so as to extend upward from the upper surface portion of the air intake duct.

In the air intake device for an engine, even when the oil filler cap and the air cleaner are disposed close to each other in the upper portion space of the engine having a turbocharger, multiple resonance tubes can be mounted in the air intake duct with an increased length of the air intake duct, and thus intake air noise (turbo air flow noise) can be reduced.

As described above, in the air intake device for an engine disclosed in JP-A No. 2012-127330, intake air noise (turbo air flow noise) can be reduced by providing the air intake duct with resonance tubes (silencers). However, in the air intake device for an engine, pressure loss of the intake air is increases by the provided silencers, and the power performance (output and torque) of the engine may be reduced.

SUMMARY OF THE INVENTION

It is desirable to provide a silencing device that is capable of silencing air flow noise caused by a supercharging device while preventing reduction in the engine power performance.

An aspect of the present invention provides a silencing device including an intake air pipe, a silencer and a heater. The intake air pipe communicates with a supercharging device configured to supercharge intake air to be sucked into an engine. The intake air pipe is configured to introduce intake air into the supercharging device. The silencer is disposed in the intake air pipe, and configured to silence air flow noise. The heater is disposed in the intake air pipe, and configured to heat the intake air introduced through the intake air pipe.

DETAILED DESCRIPTION

Figure 1:
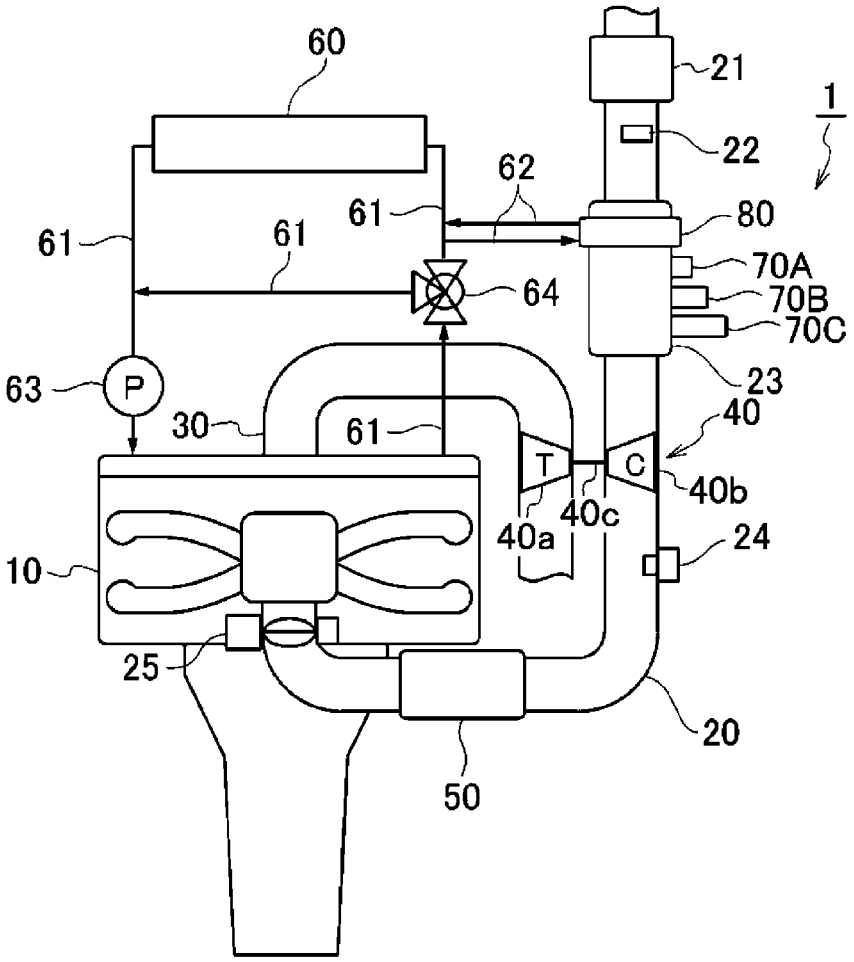
FIG. 1 is a diagram illustrating the configuration of a silencing device according to an example and an engine including the silencing device.

Hereinafter, a preferred example of the present invention will be described in detail with reference to the drawings. It is to be noted that the same symbol is used for the same or corresponding portions in the drawings. In addition, the same components are labeled with the same symbol in the diagrams, and a redundant description is omitted.

Figure 2:
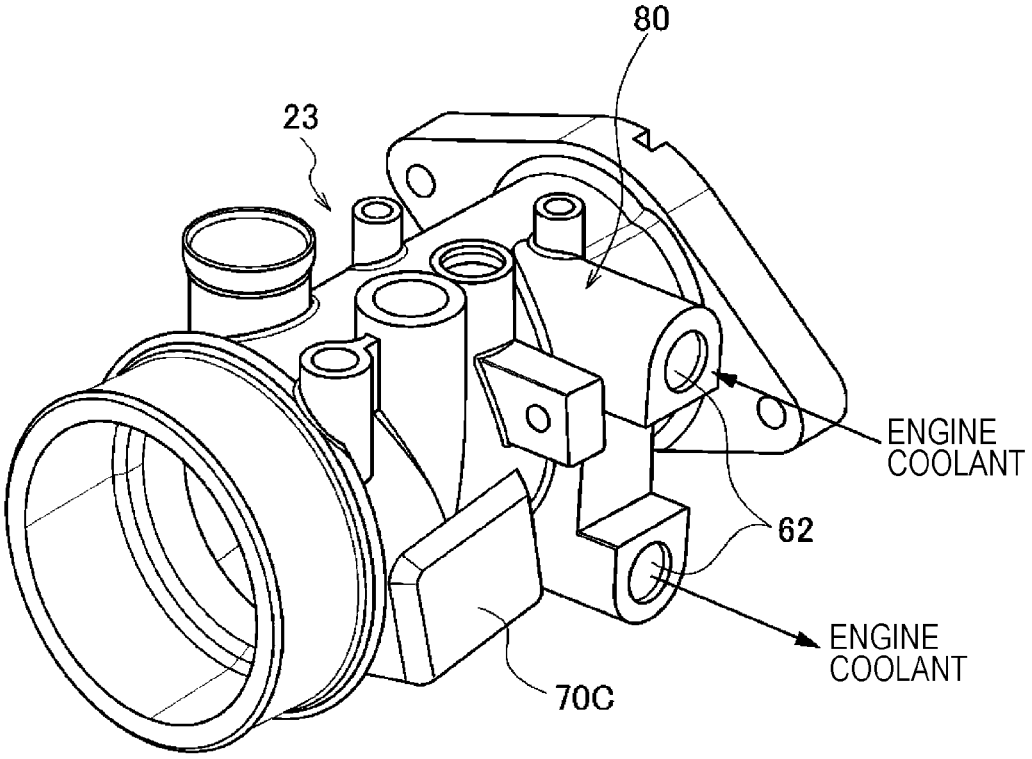
FIG. 2 is a perspective view illustrating the external appearance of a turbo front intake air pipe provided with the silencing device according to the example.
Figure 3C:
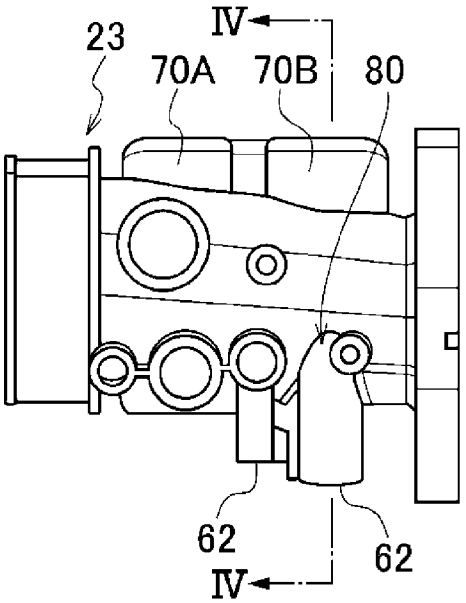
FIGS. 3A, 3B, and 3C are respectively a back view, a front view, and a plan view illustrating the external appearance of the turbo front intake air pipe provided with the silencing device according to the example.
Figure 3B:
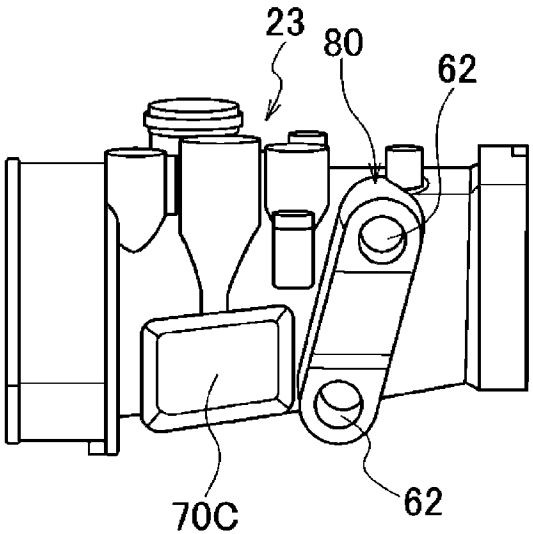
Figure 3A:
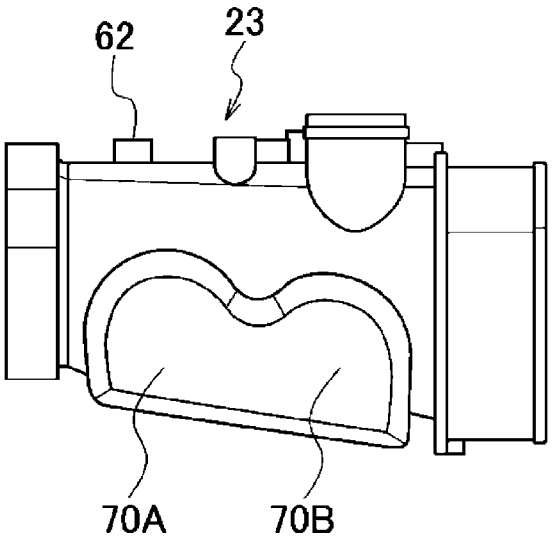
Figure 4:
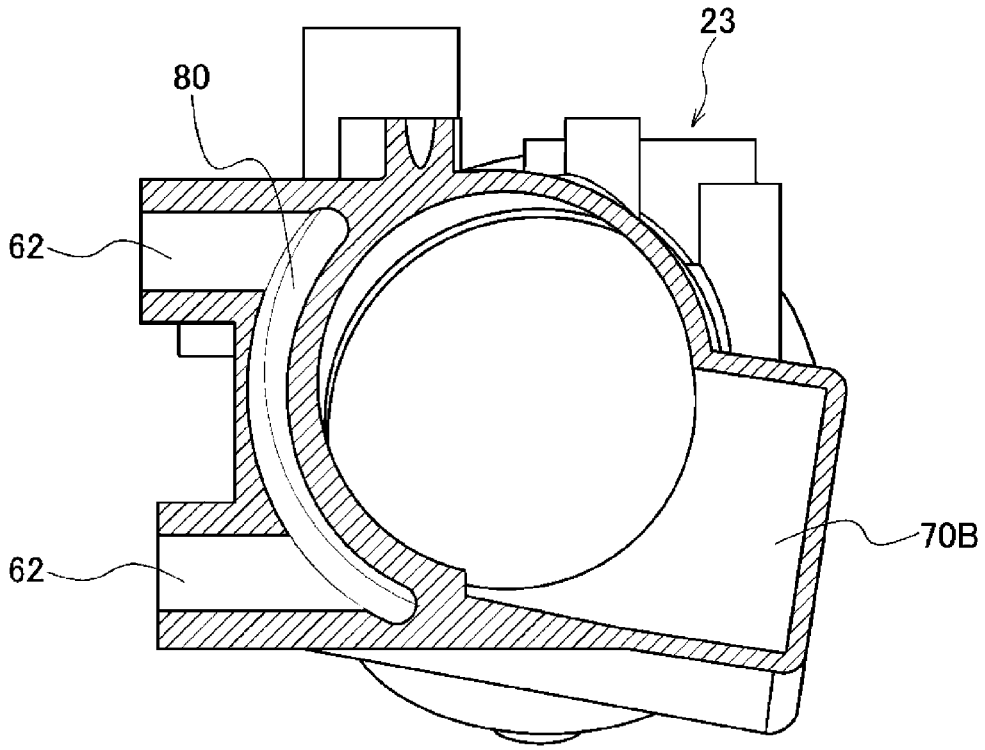
FIG. 4 is a sectional view taken along line IV-IV of FIG. 3C.

First, the configuration of a silencing device 1 according to an example will be described with reference to FIGS. 1 to 4. FIG. 1 is a diagram illustrating the configuration of a silencing device 1 for turbo air flow noise, and an engine 10 including the silencing device 1. FIG. 2 is a perspective view illustrating the external appearance of a turbo front intake air pipe 23 provided with the silencing device 1. FIGS. 3A, 3B, and 3C are respectively a back view, a front view, and a plan view illustrating the external appearance of the turbo front intake air pipe 23 provided with the silencing device 1. FIG. 4 is a sectional view taken along line IV-IV line of FIG. 3C.

The engine 10 may be of any type, and is, for instance, a horizontally opposed 4-cylinder gasoline engine. In addition, the engine 10 is a cylinder injection engine in which fuel is directly injected into a cylinder. The engine 10 supercharges intake air by a turbocharger 40, thereby achieving high output and/or low fuel consumption.

An intake air pipe 20 of the engine 10 is provided with an air cleaner 21, an air flow meter 22, a turbo front intake air pipe (turbo front intake air duct) 23, a turbocharger 40, a boost pressure sensor 24, an intercooler 50, and an electronically controlled throttle valve 25 in this order from the upstream side. The air cleaner 21 is a filter that removes the dirt and dust in intake air. The air flow meter 22 is a sensor that detects an amount of intake air in terms of mass flow rate.

The turbocharger 40 is a supercharging device that is disposed between the intake air pipe 20 and an exhaust air pipe 30 to supercharge the engine. The turbocharger 40 has a turbine 40*a* provided in the exhaust air pipe 30, and a compressor 40*b* which is provided in the intake air pipe 20 and is linked to the turbine 40*a* via a rotational shaft 40*c*, and compresses air with the coaxial compressor 40*b* by driving the turbine 40*a* with the energy of exhaust. The boost pressure sensor 24 detects a pressure (actual boost pressure) of the intake air supercharged by the turbocharger 40.

The intercooler 50 cools intake air by heat exchange with the outside air, the intake air having a high temperature due to heating (temperature raising) by the later-described heat exchanger 80, and compression by the turbocharger 40 (compressor 40*b*). The throttle valve 25 that adjusts the amount of intake air is disposed on the downstream side of the intercooler 50.

The exhaust air pipe 30 of the engine 10 is provided with the turbine 40*a* (turbocharger 40), an air-fuel ratio sensor, an exhaust air purification catalyst, and a muffler (illustration is omitted) in this order from the upstream side (the engine 10).

In the engine 10, the air sucked by the air cleaner 21 is supercharged by the turbocharger 40, and cooled by the intercooler 50, then is narrowed by the throttle valve 25 and sucked into the cylinders formed in the engine 10. In each of the cylinders, air-fuel mixture of intake air and fuel burns, and exhaust gas after the burning is discharged to exhaust air pipe (exhaust pipe) 30 via an exhaust manifold (not illustrated). The heat generated by burning of the fuel-air mixture is emitted to coolant in a water jacket formed in the cylinder head of the engine 10.

The water jacket formed in the cylinder head is connected to a first coolant pipe 61. The first coolant pipe 61 is mainly provided with a radiator 60 that radiates the heat of the engine coolant to the outside, a water pump 63 that forcibly circulates the engine coolant, and a thermostat 64 that is automatically activated according to the temperature of the engine coolant and switches between pipes (paths) through which the engine coolant flows. The water pump 63 is driven, for instance, by the engine 10, and pressurizes and discharges the engine coolant. The radiator 60 performs heat exchange between the engine coolant and the atmosphere. In the radiator 60, when the coolant passes through a radiator core unit including tubes and fins, the heat of the engine coolant is discharged to the atmosphere. At the time of engine warm-up, the thermostat 64 promotes warming-up of the engine 10 by switching between paths of the first coolant pipe 61 so as to bypass the radiator 60.

A second coolant pipe 62 for circulating the engine coolant through the later-described heat exchanger 80 is connected to the upstream side of the radiator 60 with respect to the first coolant pipe 61 (and preferably the downstream side of the thermostat 64).

As described above, the turbo front intake air pipe 23 which introduces intake air into the turbocharger 40 is disposed on the upstream side of the turbocharger 40. In the turbo front intake air pipe 23, multiple (three in this example) side branches (interference silencers) 70A, 70B, and 70C (a first side branch 70A, a second side branch 70B, and a third side branch 70C, and hereinafter, the first side branch 70A, the second side branch 70B, and the third side branch 70C may be collectively referred to as a side branch 70), which silence air flow noise by an interference effect, are disposed.

As illustrated in FIGS. 2 to 4, in this example, in order to silence (reduce) turbo air flow noise in three frequency bands, three side branches 70A, 70B, and 70C are provided corresponding to the frequency bands of the air flow noise to be silenced.

Each side branch 70 has a bottomed cylinder shape (depressed shape), and is installed to project from the pipe wall of the turbo front intake air pipe 23. In each side branch 70, its length (cylinder length) is set according to the frequency band (that is, wavelength) of turbo air flow noise to be silenced. In the side branch 70, turbo air flow noise (sound wave) enters an opening of each side branch 70 formed in the turbo front intake air pipe 23, and is reflected by an inner bottom surface of the side branch 70, and the sound wave, when returning to the opening again, is outputted from the opening with the phase delayed (inverted) by ½ wavelength, and thus both sound waves have opposite phases which are cancelled each other, thereby silencing (reducing) the turbo air flow noise.

Also, in the turbo front intake air pipe 23 (the upstream of each side branch 70), a heat exchanger (heater) 80 that heats intake air introduced through the turbo front intake air pipe 23 is disposed. The heat exchanger 80 is connected to the above-described second coolant pipe 62, and is disposed along the outer circumferential surface of the turbo front intake air pipe 23 so as to circulate (pass) the engine coolant (heated water) along the outer circumference (surroundings) of the turbo front intake air pipe 23. Consequently, the temperature of the turbo front intake air pipe 23 is raised by the high-temperature engine coolant, and thus the intake air which flows through the turbo front intake air pipe 23 is warmed. In other words, the heat exchanger 80 performs heat exchange between the engine coolant and the intake air.

It is to be noted that instead of the configuration in which the engine coolant is circulated (passed) along the outer circumference of the turbo front intake air pipe 23, the heat exchanger 80 may adopt a configuration in which the core unit including tubes and fins is disposed in the turbo front intake air pipe 23 for instance, and heat exchange is performed between the engine coolant which flows through the core unit and the intake air which flows through the turbo front intake air pipe 23 to raise the temperature of the intake air.

As described above, the silencing device 1 has the configuration in which the turbo front intake air pipe 23 is provided with three side branches 70 corresponding to the frequency bands of the air flow noise, and the second coolant pipe 62 branched from the first coolant pipe 61 is disposed along the outer circumference of the turbo front intake air pipe 23 to circulate the high-temperature engine coolant. Thus, with the silencing device 1, turbo air flow noise is silenced (reduced) by each side branch 70. Although pressure loss of the intake air is increased at this point, the temperature of the intake air is raised and friction loss is decreased by passing the high-temperature engine coolant through the turbo front intake air pipe 23, thereby preventing increase in the pressure loss, caused by each side branch 70.

More specifically, when air flows through inside the intake air pipe (turbo front intake air pipe 23), if the air velocity in the intake air pipe is the same, the higher the air temperature, the lower the air density, and thus the friction loss is smaller. Here, pressure loss ΔPt (Pa) when the intake air is heated (the temperature is raised) can be determined by the following Expression (1).

$$Pt = kt \cdot \Delta P \quad (1)$$

Here, ΔP is the pressure loss (Pa) in a standard state (20° C.), and kt is a pressure correction coefficient according to the temperature. The pressure correction coefficient kt is determined by the following Expression (2).

$$t=(273.15+20)/(273.15+ta) \quad (2)$$

Here, ta is the air temperature (° C.) in the turbo front intake air pipe 23.

As described above, the intake air heated (the temperature is raised) by the heat exchanger 80 is cooled by the intercooler 50. Therefore, the filling efficiency of the engine 10 is not reduced, and thus the power performance is not degraded. In this manner, both silencing (reducing) the turbo air flow noise and ensuring the engine power performance are achieved.

As described above in detail, in this example, the side branch 70 is disposed in the turbo front intake air pipe 23, which introduces intake air into the turbocharger 40, and thus turbo air flow noise is silenced by the side branch 70. Also, since the heat exchanger 80, which heats intake air introduced through the turbo front intake air pipe 23, is disposed in the turbo front intake air pipe 23, the intake air is heated (the temperature is raised) by the heat exchanger 80, thereby reducing the friction loss, and reducing the pressure loss caused by the side branch 70. Thus, reduction of the power performance of the engine 10 is reduced. Consequently, it is possible to silence the air flow noise by the turbocharger 40 while preventing reduction in the engine power performance.

According to this example, heat exchange is performed between the intake air and the engine coolant. Thus, the intake air can be heated (the temperature is raised) by utilizing the engine coolant which is heated to a high temperature by the heat from the engine 10.

According to this example, engine coolant is introduced from the upstream side of the radiator 60 (and the downstream side of the thermostat 64). Thus, the intake air can be heated (the temperature is raised) by using engine coolant having a temperature higher than the temperature of the engine coolant before cooled by the radiator 60.

According to this example, intake air having a high temperature due to heating (temperature raising) by the heat exchanger 80, and compression by the turbocharger 40 is cooled by the intercooler 50. Thus, the filling efficiency of the engine 10 can be improved and both silencing (reducing) the turbo air flow noise and ensuring the engine power performance can be achieved.

According to this example, multiple (three in this example) side branches 70A, 70B, and 70C are provided corresponding to the frequency bands of the air flow noise to be silenced, and thus multiple types of air flow noise with different frequency bands can be silenced while the engine power performance is being ensured.

Although the example of the invention has been described above, the present invention is not limited to the above-described example and various modifications are possible. Although the turbocharger is used as the supercharging device of the engine 10 in the example, instead of the turbocharger, for instance, a supercharging device in another form, such as a supercharger may be used.

Although the heat exchanger 80, which performs heat exchange between engine coolant and intake air, is used in the example, instead of the engine coolant, heat exchange may be performed between engine oil and intake air, or transmission oil and intake air, for instance. Also, instead of the heat exchanger 80, for instance, a heater, such as an electric heater (air heater) may be used.

It is to be noted that although the side branch 70 (interference silencer) is used as the silencer in the example, a silencer in another form, for instance, a resonance silencer, such as a resonator may be used. Although three side branches 70A, 70B, and 70C are provided corresponding to the frequency bands of the air flow noise to be silenced in the example, the number of side branches 70 is not limited to three.

The invention claimed is:

1. A silencing device, comprising:

an intake air pipe that communicates with a supercharging device configured to supercharge intake air to be sucked into an engine, the intake air pipe being configured to introduce intake air into the supercharging device;

an intake air duct attached to the intake air pipe and disposed upstream of the supercharging device;

a silencer disposed in the intake air duct, and configured to silence air flow noise; and a heater disposed in the intake air duct, and configured to heat the intake air introduced through the intake air pipe and to reduce a pressure loss of the intake air caused by the silencer.

2. The silencing device according to claim 1, wherein the silencer includes one of an interference silencer configured to silence the air flow noise by an interference effect and a resonance silencer configured to silence the air flow noise by a resonance effect.

3. The silencing device according to claim 1, wherein the heater includes a heat exchanger configured to perform heat exchange between the intake air and a liquid having a temperature higher than a temperature of the intake air.

4. The silencing device according to claim 2, wherein the heater includes a heat exchanger configured to perform heat exchange between the intake air and a liquid having a temperature higher than a temperature of the intake air.

5. The silencing device according to claim 3, wherein the heat exchanger performs heat exchange between the intake air and an engine coolant configured to cool the engine.

6. The silencing device according to claim 4, wherein the heat exchanger performs heat exchange between the intake air and an engine coolant configured to cool the engine.

7. The silencing device according to claim 5, further comprising a second coolant pipe in which one end is connected to the heat exchanger and an other end is connected to a first coolant pipe by which the engine communicates with a radiator.

8. The silencing device according to claim 6, further comprising a second coolant pipe in which one end is connected to the heat exchanger and an other end is connected to a first coolant pipe by which the engine communicates with a radiator.

9. The silencing device according to claim 1, wherein the supercharging device comprises an intercooler disposed downstream of the supercharging device, the intercooler being configured to cool intake air compressed by the supercharging device.

10. The silencing device according to claim 2, wherein the supercharging device comprises an intercooler disposed downstream of the supercharging device, the intercooler being configured to cool intake air compressed by the supercharging device.

11. The silencing device according to claim 3, wherein the supercharging device comprises an intercooler disposed downstream of the supercharging device, the intercooler being configured to cool intake air compressed by the supercharging device.

12. The silencing device according to claim 4, wherein the supercharging device comprises an intercooler disposed downstream of the supercharging device, the intercooler being configured to cool intake air compressed by the supercharging device.

13. The silencing device according to claim 1, wherein the silencer comprises a plurality of silencers provided according to frequency bands of air flow noise to be silenced.

14. The silencing device according to claim 2, wherein the silencer comprises a plurality of silencers provided according to frequency bands of air flow noise to be silenced.

15. The silencing device according to claim 3, wherein the silencer comprises a plurality of silencers provided according to frequency bands of air flow noise to be silenced.

16. The silencing device according to claim 4, wherein the silencer comprises a plurality of silencers provided according to frequency bands of air flow noise to be silenced.

17. The silencing device according to claim 1, wherein the supercharging device includes a turbocharger comprising a turbine disposed on an air exhaust pipe of the engine, and a compressor disposed on the intake air pipe and coupled to the turbine via a shaft, the turbocharger being configured to use energy of an exhaust gas to supercharge the intake air.

18. The silencing device according to claim 2, wherein the supercharging device includes a turbocharger comprising a turbine disposed on an air exhaust pipe of the engine, and a compressor disposed on the intake air pipe and coupled to the turbine via a shaft, the turbocharger being configured to use energy of an exhaust gas to supercharge the intake air.

19. The silencing device according to claim 3, wherein the supercharging device includes a turbocharger comprising a turbine disposed on an air exhaust pipe of the engine, and a compressor disposed on the intake air pipe and coupled to the turbine via a shaft, the turbocharger being configured to use energy of an exhaust gas to supercharge the intake air.

20. The silencing device according to claim 4, wherein the supercharging device includes a turbocharger comprising a turbine disposed on an air exhaust pipe of the engine, and a compressor disposed on the intake air pipe and coupled to the turbine via a shaft, the turbocharger being configured to use energy of an exhaust gas to supercharge the intake air.

* * * * *